US007997092B2

(12) United States Patent
Lifson et al.

(10) Patent No.: US 7,997,092 B2
(45) Date of Patent: Aug. 16, 2011

(54) REFRIGERANT VAPOR COMPRESSION SYSTEM OPERATING AT OR NEAR ZERO LOAD

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 12/679,757

(22) PCT Filed: Sep. 26, 2007

(86) PCT No.: PCT/US2007/020788

§ 371 (c)(1), (2), (4) Date: Mar. 24, 2010

(87) PCT Pub. No.: WO2009/041942

PCT Pub. Date: Apr. 2, 2009

(65) Prior Publication Data

US 2010/0199712 A1 Aug. 12, 2010

(51) Int. Cl.
*F25B 1/00* (2006.01)

(52) U.S. Cl. ..... 62/115; 62/226; 62/228.4

(58) Field of Classification Search ..... 62/115, 62/513, 498, 228.4, 218, 222, 226; 251/129.05
See application file for complete search history.

(56) References Cited

U.S. PATENT DOCUMENTS 4,475,360 A 10/1984 Suefuji et al.
4,787,211 A * 11/1988 Shaw ..... 62/117
5,174,123 A 12/1992 Erickson
5,381,665 A 1/1995 Tanaka
5,596,878 A 1/1997 Hanson et al.
6,047,556 A 4/2000 Lifson
6,058,729 A 5/2000 Lifson et al.
6,202,438 B1 * 3/2001 Barito ..... 62/513
6,318,100 B1 11/2001 Brendel et al.
6,474,087 B1 * 11/2002 Lifson ..... 62/199
6,571,576 B1 6/2003 Lifson et al.
6,615,598 B1 9/2003 Wang et al.
6,709,244 B2 * 3/2004 Pham ..... 417/292
6,925,822 B2 * 8/2005 Lifson et al. ..... 62/175
6,925,823 B2 * 8/2005 Lifson et al. ..... 62/196.3
7,114,349 B2 10/2006 Lifson et al.
7,204,099 B2 4/2007 Lifson et al.
7,251,947 B2 8/2007 Lifson et al.
2005/0150246 A1 7/2005 Takegami et al.

OTHER PUBLICATIONS

International Search Report and Written Opinion mailed Apr. 28, 2008 (10 pgs.).
International Preliminary Report on Patentability mailed Apr. 8, 2010 (7 pgs.).

* cited by examiner

*Primary Examiner* — Mohammad Ali
(74) *Attorney, Agent, or Firm* — Cantor Colburn LLP

(57) ABSTRACT

A method is provided for operating a refrigerant vapor compression system at substantially zero cooling capacity to facilitate tight temperature control within a climate-controlled environment associated with the refrigerant vapor compression system. The method includes the step of diverting substantially all refrigerant flow from the primary refrigerant flow circuit of the refrigerant vapor compression system at a first location downstream, with respect to refrigerant flow, of the heat rejection heat exchanger and upstream, with respect to refrigerant flow, of the evaporator refrigerant expansion device to reenter the primary refrigerant flow circuit at a second location downstream, with respect to refrigerant flow, of the evaporator and upstream, with respect to refrigerant flow, of the compression device.

15 Claims, 3 Drawing Sheets

REFRIGERANT VAPOR COMPRESSION SYSTEM OPERATING AT OR NEAR ZERO LOAD

FIELD OF THE INVENTION

This invention relates generally to refrigerant vapor compression systems and, more particularly, to continuous operation of a refrigerant vapor compression system at very low or zero thermal load.

BACKGROUND OF THE INVENTION

Refrigerant vapor compression systems are well known in the art and commonly used for conditioning air (or other secondary media) to be supplied to a climate-controlled comfort zone within a residence, office building, hospital, school, restaurant or other facility. Refrigerant vapor compression systems are also commonly used in transport refrigeration for cooling air supplied to a temperature-controlled cargo space of a truck, trailer, container or the like for transporting perishable or frozen items, and in commercial refrigeration for cooling air supplied to a temperature-controlled space in a cold room, a beverage cooler, a diary case or a refrigerated merchandiser for displaying perishable food items in a chilled or frozen state, as appropriate. Typically, these refrigerant vapor compression systems include: a compressor, a heat rejection heat exchanger, an evaporator; and an expansion device. Commonly, the expansion device, typically a fixed orifice, a capillary tube, a thermostatic expansion valve (TXV) or an electronic expansion valve (EXV), is disposed in the refrigerant line upstream, with respect to refrigerant flow, of the evaporator and downstream of the condenser. These basic refrigerant vapor compression system components are serially interconnected by refrigerant lines in a closed-loop refrigerant circuit, arranged in accord with known refrigerant vapor compression cycles. The heat rejection heat exchanger functions as a refrigerant vapor condenser in subcritical cycles and a refrigerant vapor cooler in transcritical cycles.

To improve performance of the refrigerant vapor compression system and to control the temperature of the refrigerant vapor discharged from the final stage of the compressor over a wide range of operating conditions, it is known to equip such systems with an economizer cycle incorporating a refrigerant-to-refrigerant economizer heat exchanger. The economizer heat exchanger is generally disposed in the refrigerant circuit intermediate the condenser and the evaporator, with respect to refrigerant flow. In the economized mode of operation, at least a portion of the refrigerant leaving the condenser is diverted from the primary refrigerant circuit, expanded to an intermediate pressure and then passed through the economizer heat exchanger in heat exchange relationship with the main portion of the refrigerant leaving the condenser. In this manner, any liquid in the economized expanded refrigerant flow is typically evaporated, and then the economized refrigerant flow is typically superheated, while the refrigerant passing through the primary refrigerant circuit from the condenser to the evaporator is further cooled. Typically, the expanded refrigerant vapor is injected into an intermediate stage in the compression process, either through an injection port or ports opening into an intermediate pressure stage of the compression chamber (or chambers) of a single compressor or, in the case of a multiple compressor system, into a refrigerant line extending between the discharge outlet of the upstream compressor and the suction inlet of the downstream compressor.

Conventional refrigerant vapor compression systems, whether economized or non-economized, often include a suction modulation valve (SMV) that is interdisposed in the refrigerant circuit downstream, with respect to refrigerant flow, of the evaporator and upstream, with respect to refrigerant flow, of the suction inlet to the compressor. The suction modulation valve functions under the direction of the system controller to throttle refrigerant flow through the compressor and subsequently through the evaporator, by reducing the refrigerant pressure at the suction inlet to the compressor (suction inlet pressure). In operation, when a reduction in system capacity is desired, the system controller selectively further closes the SMV to reduce refrigerant flow to the compressor. Conversely, when an increase in system capacity is desired, the system controller selectively further opens the SMV to increase refrigerant flow to the compressor.

Although the SMV may be positioned fully opened when the system is operating at or near its maximum capacity, in conventional refrigerant vapor compression systems, the SMV cannot be positioned fully closed or even nearly fully closed due to resultant problems. For example, a minimum suction inlet pressure is required for proper operation of the compressor. If the suction inlet pressure was to fall below this minimum threshold pressure, such as would result from closing the SMV down too much, the compressor would overheat and oil delivery by the oil pump with the compressor could be comprised. Additionally, the mass flow rate of the refrigerant circulating through the refrigerant circuit could become so low that oil would be retained within the evaporator or in the suction line upstream of the compressor, rather than entering the compressor, which ultimately could lead to substantially all of the oil being pumped out of the compressor and consequent compressor failure. Therefore, in conventional refrigerant vapor compression systems, desired control of refrigerant flow through the evaporator to very low or even zero flow may not be achievable, thereby limiting the ability to attain tight temperature control in the controlled environment with which the evaporator is associated. In the prior art, the refrigerant vapor compression system would cycle on and off to obtain time-averaged near zero capacity, which is undesirable from the reliability and temperature control perspectives.

U.S. Pat. No. 6,058,729 discloses a method of optimizing cooling capacity, energy efficiency and reliability of an economized refrigerant vapor compression system for a transport refrigeration unit when operating at or near maximum capacity, during the pulldown, of product temperature within the associated storage container. The disclosed refrigerant vapor compression system incorporates a refrigerant-to-refrigerant heat exchanger into the refrigerant circuit as an economizer. The disclosed system also includes a suction modulation valve (SMV) for throttling refrigerant flow to the suction inlet of the compressor and an intermediate pressure-to-suction pressure unloading circuit for compressor capacity control.

U.S. Pat. No. 7,114,349 discloses a refrigerant vapor compression system with a refrigerant-to-refrigerant heat exchanger interdisposed in the refrigerant circuit downstream of the condenser, with respect to refrigerant flow, and upstream of the evaporator, with respect to refrigerant flow. Through various bypass lines and manipulation of various open/closed solenoid valves associated with the bypass lines, this heat exchanger may be operated either as an economizer heat exchanger or as a liquid-suction heat exchanger. When the system is operating with the refrigerant-to-refrigerant heat exchanger functioning as an economizer, refrigerant is passed from the primary refrigerant circuit through an economizer expansion device and thence through the refrigerant-to-refrigerant heat exchanger in heat exchange relationship with the main portion of the refrigerant passing through the primary refrigerant circuit from the condenser to the evaporator. After traversing the refrigerant-to-refrigerant heat exchanger, the expanded refrigerant is injected into an intermediate pressure stage of the compressor or returned to the primary refrigerant circuit at a point downstream, with respect to refrigerant flow, of the evaporator and upstream of the suction inlet of the compressor. In the disclosed system, the conventional suction modulation valve is replaced by an open/closed solenoid valve, which may be selectively closed to prevent refrigerant flow from passing directly from the evaporator outlet to the suction inlet of the compressor, and divert that flow to pass through the refrigerant-to-refrigerant heat exchanger prior to passing into the compressor suction inlet.

SUMMARY OF THE INVENTION

Methods and various system configurations are provided for operating a refrigerant vapor compression system at very low or zero cooling capacity for maintaining tight temperature control within an associated temperature-controlled environment.

The method of operating a refrigerant vapor compression system at substantially zero capacity includes the step of diverting substantially all refrigerant flow from the primary refrigerant flow circuit of the refrigerant vapor compression system at a first location downstream, with respect to refrigerant flow, of the condenser and upstream, with respect to refrigerant flow, of the evaporator refrigerant expansion device to reenter the primary refrigerant flow circuit at a second location downstream, with respect to refrigerant flow of the evaporator, and upstream, with respect to refrigerant flow, of the compression device.

In an embodiment, the method further includes the steps of: providing an evaporator flow control valve in the refrigerant flow circuit downstream with respect to refrigerant flow of the evaporator and upstream with respect to refrigerant flow of the second location, providing a bypass line establishing refrigerant flow communication between the first location and the second location, providing a bypass flow control valve interdisposed in the bypass line; and selectively closing the evaporator flow control valve and simultaneously opening the bypass flow control valve to divert substantially all refrigerant flow from the refrigerant flow circuit at the first location through the bypass line to reenter the refrigerant flow circuit at the second location.

In an embodiment, the method of operating a refrigerant vapor compression system at very low or zero capacity further includes the steps of: providing an electronic expansion valve as the evaporator refrigerant expansion device, providing a bypass line establishing refrigerant flow communication between the first location and the second location, providing a bypass flow control valve interdisposed in the bypass line, and selectively closing the electronic expansion valve and simultaneously opening the bypass flow control valve to divert substantially all refrigerant flow from the refrigerant flow circuit at the first location through the bypass line to reenter said refrigerant flow circuit at the second location.

The step of providing a bypass flow control valve interdisposed in the bypass line may include providing a solenoid valve having a first closed position and a second open position. The step of providing an evaporator flow control valve in the refrigerant flow circuit may include providing a suction modulation valve in the refrigerant flow circuit or providing a solenoid valve having a first closed position and a second open position in the refrigerant flow circuit. The method may also include the further of providing a bypass flow expansion device interdisposed in the bypass line upstream with respect to refrigerant flow therethrough of the bypass flow control valve.

In a further aspect of the invention, a refrigerant vapor compression system is provided. The refrigerant vapor compression system includes a primary refrigerant circuit including a refrigerant vapor compression device, a refrigerant heat rejection heat exchanger, a refrigerant heat absorption heat exchanger, and a primary expansion device interdisposed in the primary refrigerant circuit downstream, with respect to refrigerant flow, of the refrigerant heat rejection heat exchanger and upstream, with respect to refrigerant flow, of the refrigerant heat absorption heat exchanger. A bypass circuit is provided that includes a bypass line establishing refrigerant flow communication between a first location in the primary refrigerant circuit upstream, with respect to refrigerant flow, of the refrigerant heat absorption heat exchanger and a second location in the primary refrigerant circuit downstream, with respect to refrigerant flow, of the refrigerant heat absorption heat exchanger, and a bypass flow control device interdisposed in the bypass line and operative to control the amount of refrigerant flow passing through the bypass line. A suction flow control solenoid valve is disposed in the primary refrigerant circuit downstream, with respect to refrigerant flow, of the refrigerant heat absorption heat exchanger and upstream, with respect to refrigerant flow, of the second location in the primary refrigerant circuit. The suction flow control solenoid valve has a first fully open position whereat refrigerant may pass therethrough and a second closed position whereat refrigerant is blocked from passing therethrough.

In an embodiment, the bypass flow control device comprises a bypass flow control valve having at least a first open position whereat refrigerant may flow through the bypass line and a second closed position whereat refrigerant is blocked from flowing through the bypass line. In an embodiment, the bypass flow control device comprises a solenoid valve selectively positionable in a first open position and in a second closed position. In an embodiment, the bypass flow control device comprises a bypass flow control valve selectively positionable in a first open position, in a second closed position and at least one partially open position between the first open position and the second closed position. In an embodiment, the bypass flow control device comprises a flow restriction device having a fixed flow area passage therethrough. In an embodiment, the bypass flow control device comprises a fixed area flow restriction device in series with a two-position open/closed solenoid valve. In an embodiment, the bypass flow control device comprises a flow restriction device having a variable flow area passage therethrough.

In an aspect of the invention, the refrigerant vapor compression system may also include an economizer circuit including an economizer and an economizer refrigerant line in refrigerant flow communication between the economizer and an intermediate pressure point in a compression process carried out in the compression device. In an embodiment, the economizer may comprise a refrigerant-to-refrigerant heat exchanger through which refrigerant passing through the bypass line passes in heat exchange relationship with the refrigerant passing through the primary refrigerant circuit. In another embodiment, the bypass line establishes flow communication between a first location in the primary refrigerant circuit downstream, with respect to refrigerant flow, of the economizer and upstream, with respect to refrigerant flow, of the refrigerant heat absorption heat exchanger and a second location in the primary refrigerant circuit downstream, with respect to refrigerant flow, of the refrigerant heat absorption heat exchanger.

BRIEF DESCRIPTION OF THE DRAWINGS

For a further understanding of the invention, reference will be made to the following detailed description of the invention which is to be read in connection with the accompanying drawing, where.

DETAILED DESCRIPTION OF THE INVENTION

Figure 1:
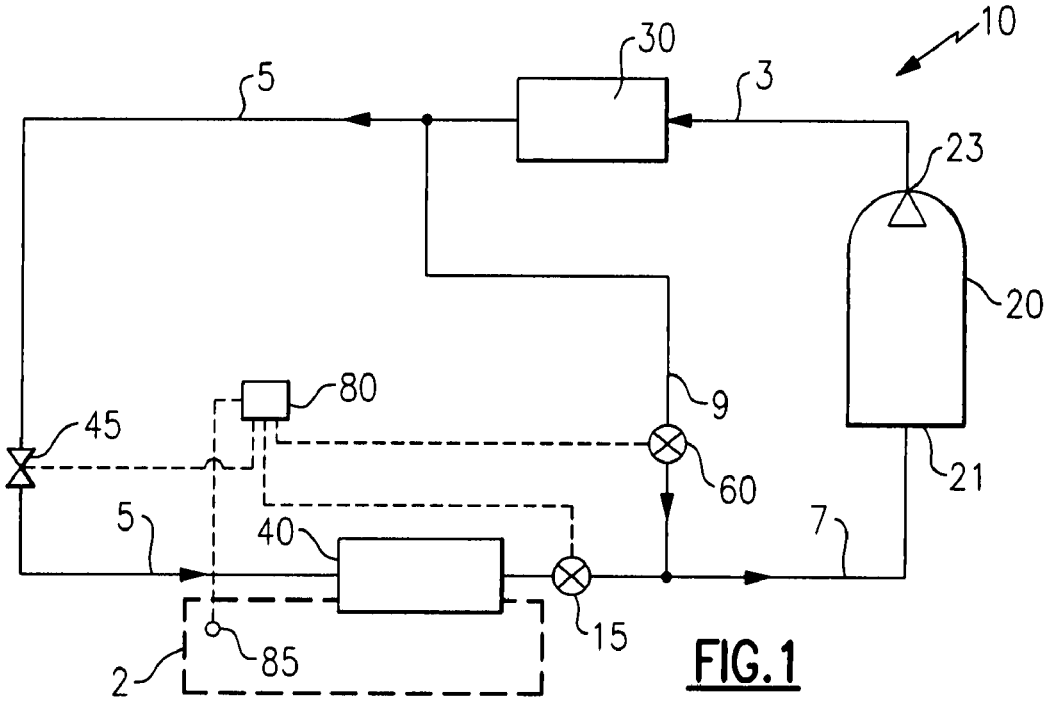
FIG. 1 is a schematic diagram illustrating a first exemplary embodiment of a non-economized refrigerant vapor compression system in accord with the invention.
Figure 2:
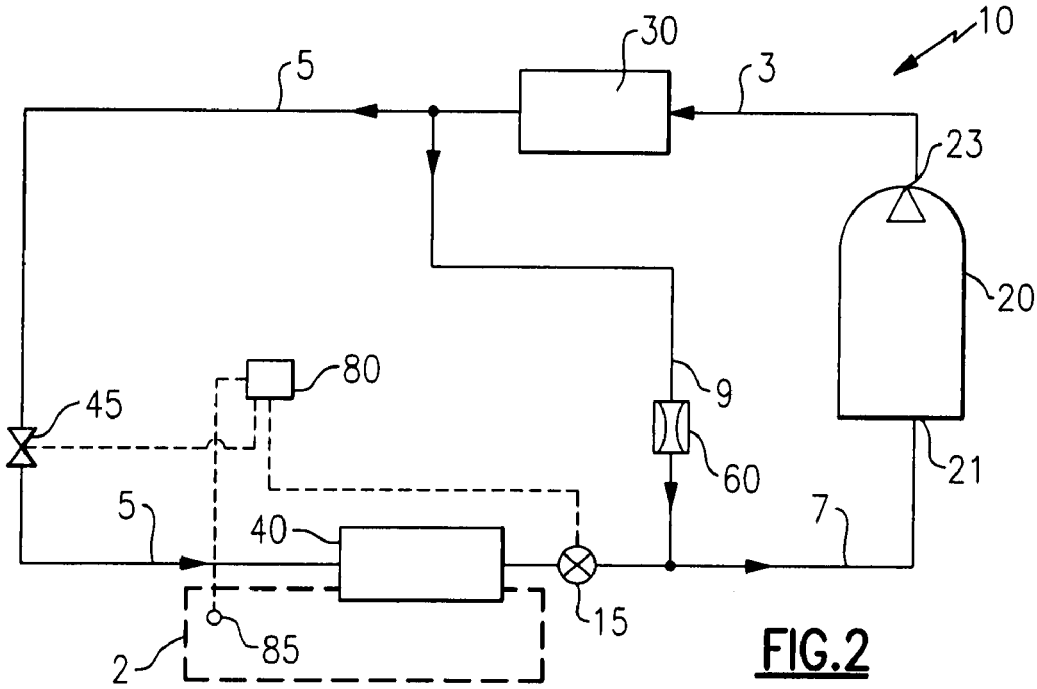
FIG. 2 is a schematic diagram illustrating a second exemplary embodiment of an economized refrigerant vapor compression system in accord with the invention.
Figure 3:
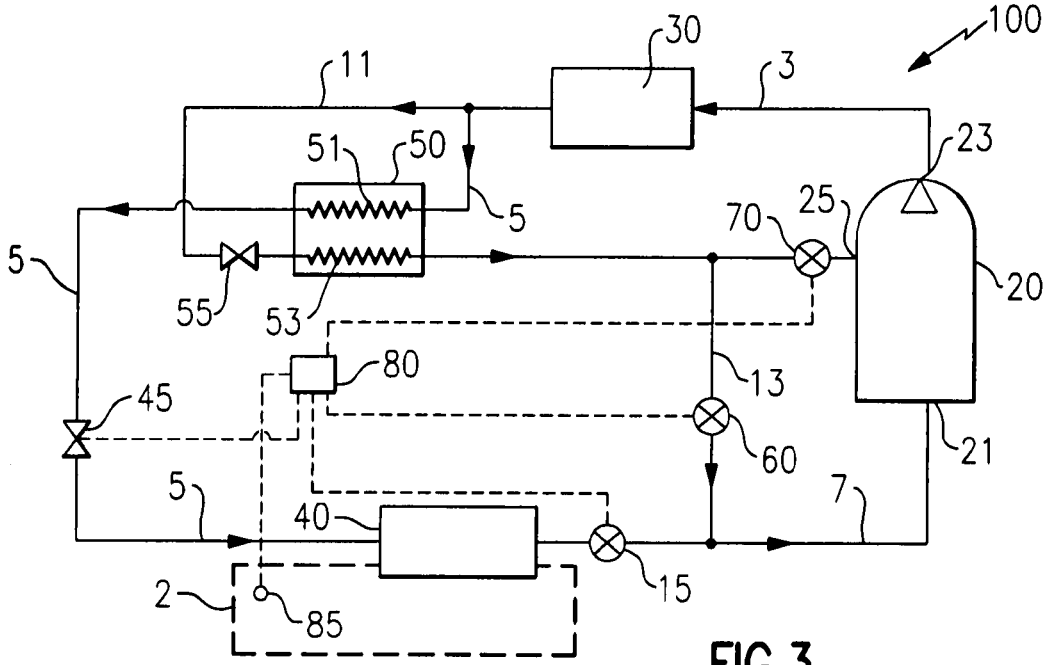
FIG. 3 is a schematic diagram illustrating a first exemplary embodiment of an economized refrigerant vapor compression system in accord with the invention.
Figure 4:
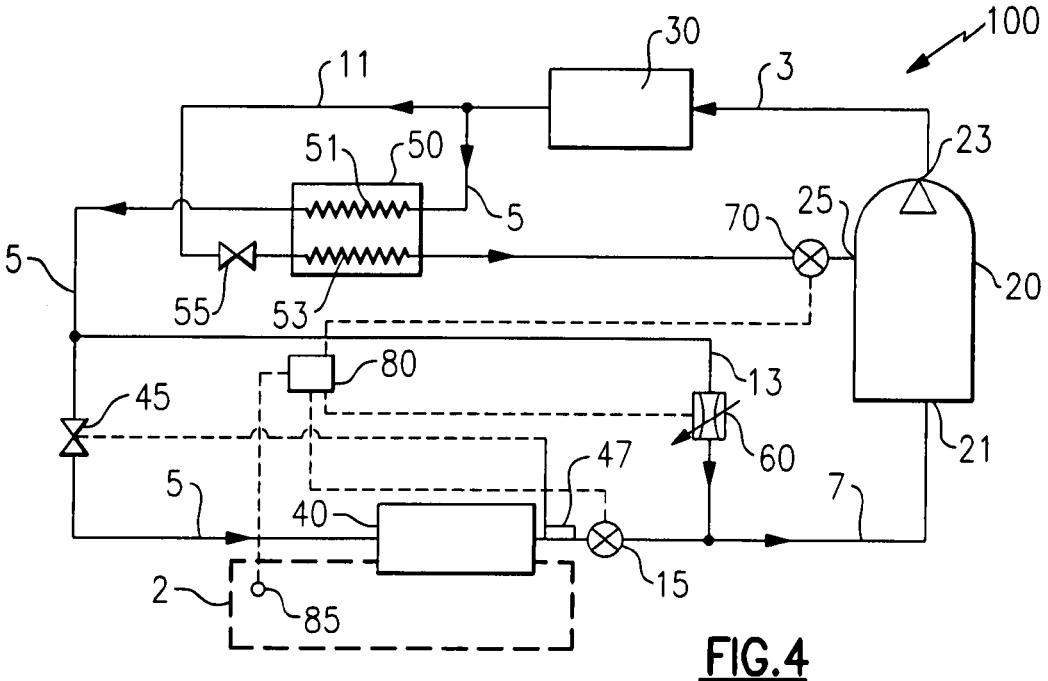
FIG. 4 is a schematic diagram illustrating a second exemplary embodiment of an economized refrigerant vapor compression system in accord with the invention.

The invention will be described further herein with respect to the exemplary embodiments of the refrigerant vapor compression systems 10 and 100 depicted in FIGS. 1, 2, 3 and 4, respectively. The respective refrigerant vapor compression systems 10 depicted in FIGS. 1, 2, 5 and 6 are exemplary of a non-economized embodiment of a refrigerant vapor compression system. The respective refrigerant vapor compression systems 100 depicted in FIGS. 3 and 4 are exemplary of an economized embodiment of a refrigerant vapor compression system. As in conventional systems, each of the refrigerant vapor compression systems 10, 100 includes a compression device 20, a heat rejection heat exchanger 30, an evaporator expansion device 45, and an evaporator 40, interconnected by various refrigerant lines 3, 5 and 7 in serial refrigerant flow communication in a refrigerant circuit of a conventional refrigerant cycle. A suction flow control valve 15 is disposed in the refrigerant line 7 of the refrigerant circuit downstream, with respect to refrigerant flow, of the evaporator 40 and upstream, with respect to refrigerant flow, of the suction inlet 21 of the compressor 20.

The refrigerant vapor compression systems 10, 100 are suitable for use in a transport refrigeration system for cooling the air or other gaseous atmosphere within the temperature-controlled cargo space 2 of a truck, trailer, container or the like for transporting perishable/frozen goods. The refrigerant vapor compression systems 10, 100 are also suitable for use in conditioning air to be supplied to a climate-controlled comfort zone 2 within a residence, office building, hospital, school, restaurant or other facility. The refrigerant vapor compression systems 10, 100 are also suitable for use in cooling air supplied to the food storage zone 2 of a display case, merchandiser, freezer cabinet, cold room or other perishable/frozen product storage areas in commercial establishments.

In the non-economized refrigerant vapor compression system 10, the compression device 20 generally comprises a single stage refrigerant compressor, such as, for example, a scroll compressor, a rotary compressor, a screw compressor, a centrifugal compressor or the like. In the economized refrigerant vapor compression system 100, the compression device 20 may comprise a single, multi-stage compressor having at least a first compression stage and a second compression stage, such as, for example, a scroll compressor, or a screw compressor having staged compression pockets, or a reciprocating compressor having at least a first bank of cylinders and a second bank of cylinders, or a pair of single-stage compressors connected in series refrigerant flow relationship (not shown), such as, for example, a pair of scroll compressors, screw compressors, centrifugal compressors, reciprocating compressors (or separate cylinders of a single reciprocating compressor) or rotary compressors, with the discharge outlet of the upstream compressor connected in serial refrigerant flow communication with the suction inlet of the downstream compressor.

The refrigerant heat rejection heat exchanger 30, which functions as a condenser for subcritical applications and as a gas cooler for transcritical applications, may comprise, for example, a finned tube heat exchanger, such as for example a plate fin and round tube heat exchanger or a fin and minichannel flat tube heat exchanger, wherein the refrigerant is cooled as it passes through the heat exchanger tubes in heat exchange relationship with ambient (typically outdoor) air being drawn through the finned tube heat exchanger by an air mover, such as one or more fans (not shown) operatively associated with the heat exchanger.

The evaporator 40, which operatively interfaces with the climate-controlled environment 2, functions as a refrigerant heat absorbing heat exchanger through which the liquid or liquid/vapor refrigerant mixture passes in heat exchange relationship with a secondary fluid, typically air to be supplied to the climate-controlled environment 2, to be cooled, and typically dehumidified, before being delivered to the conditioned environment. The refrigerant is heated thereby evaporating the liquid component and typically superheating the resultant vapor. In an embodiment, the evaporator 40 may comprise a finned tube heat exchanger through which refrigerant passes in heat exchange relationship with air that may be at least partially drawn from and returned to a climate-controlled environment by the one or more fans (not shown) operatively associated with the evaporator 40. The finned tube heat exchanger may comprise, for example, a plate fin and round tube heat exchanger or a fin and minichannel flat tube heat exchanger. The evaporator expansion device 45 may be a restriction type expansion device, such as a capillary tube or a fixed plate orifice, a thermostatic expansion valve or an electronic expansion valve.

As noted previously, the refrigerant vapor compression systems 10 depicted in FIGS. 1, 2, 5 and 6 are non-economized refrigerant vapor compression systems. In these embodiments, the refrigerant vapor compression system 10 further includes an evaporator bypass circuit comprising an evaporator bypass refrigerant line 9 and a bypass flow control device 60. The evaporator bypass refrigerant line 9 establishes refrigerant flow communication between the refrigerant line 5 of the primary refrigerant circuit at a location downstream, with respect to refrigerant flow, of the heat rejection heat exchanger 30 and upstream, with respect to refrigerant flow, of the evaporator expansion device 45 and the refrigerant line 7 of the primary refrigerant circuit at a location downstream, with respect to refrigerant flow, of the suction flow control valve 15 and upstream, with respect to refrigerant flow, of the suction inlet 21 to the compression device 20.

Figure 5:
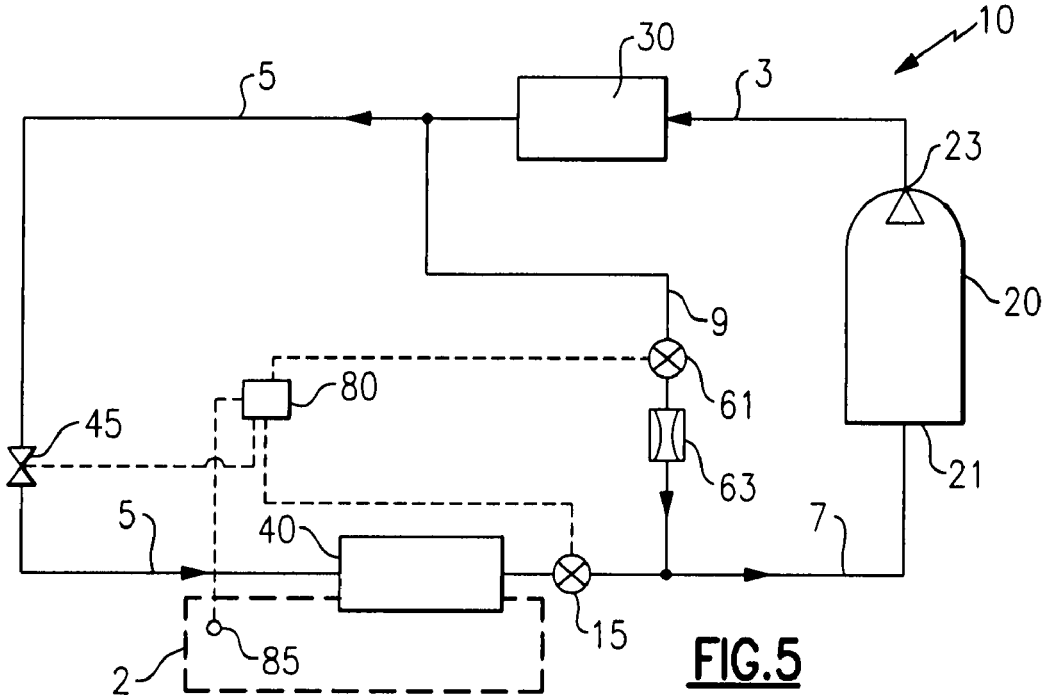
FIG. 5 is a schematic diagram illustrating a third exemplary embodiment of a non-economized refrigerant vapor compression system in accord with the invention.

The flow control device 60 may be a valve or a fixed restriction type device. If it is a fixed restriction flow control device, for example, a capillary tube or a fixed orifice, such as illustrated in FIG. 2, it would allow a continuous bleeding of refrigerant to the refrigerant line 7. In case it is desired to prevent continuous bleeding of the refrigerant into the refrigerant line 7, the flow control device 60 may comprise a fixed restriction device 63 installed in series with a shutoff solenoid valve 61, for example a two-position open/closed solenoid valve, such as illustrated in FIG. 5. If the flow control device 60 is a valve, such as illustrated in FIGS. 1 and 3, then it can be operated in the ON/OFF mode or have a variable opening. If the flow control device 60 operates in the ON/OFF mode, it may be a regular solenoid valve that is opened (ON position), for instance, when the suction flow control valve 15 is opened, and additional fixed amount of refrigerant is added through the opened valve 60. The valve 60 can also be a valve that is cycled rapidly between open and closed positions, with the cycling rate adjusted to control the amount of liquid refrigerant entering the compressor. The valve 60 may also be of a variable restriction type, where the amount of refrigerant entering the compressor is controlled by the size of the restriction. If the valve 60 is a variable restriction type device, such as illustrated in FIG. 4, the size of the restriction can be controlled, for instance, by a miniature motor.

Figure 6:
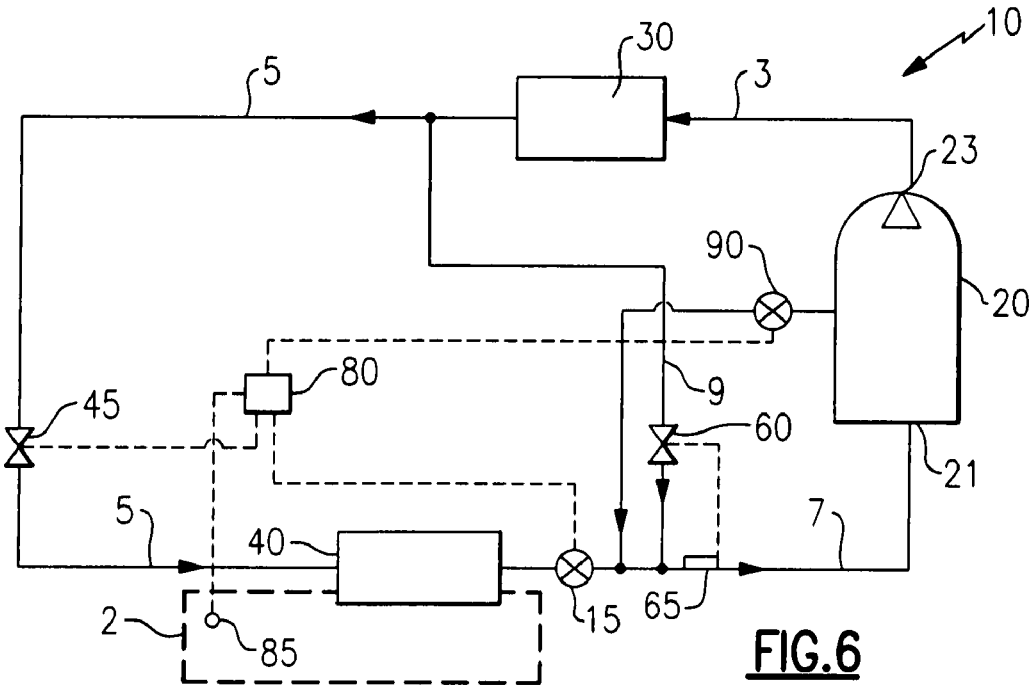
FIG. 6 is a schematic diagram illustrating a fourth exemplary embodiment of a non-economized refrigerant vapor compression system in accord with the invention.

The non-economized system 10 depicted in FIG. 6 further includes a compressor unloading circuit comprising an unloading bypass line 19 and a bypass valve 90 interdisposed in the unloading bypass line 19. The unloading bypass line 19 establishes refrigerant flow communication between an intermediate pressure point in the compression process within the compressor 20 and the refrigerant line 7 of the primary refrigerant circuit, that is at a location downstream, with respect to refrigerant flow, of the evaporator 40 and upstream, with respect to refrigerant flow, of the compressor 20 whereat the refrigerant is at suction pressure. In normal operation, the bypass valve 90 is closed so that no refrigerant passes through the unloading bypass line 19. When it is desired to rapidly reduce the output of the compressor 20, the controller 80 may open the bypass valve 90 so as to pass at least a portion of refrigerant from an intermediate pressure point of the compression process through the unloading bypass line 19 to the refrigerant line 7 upstream of the suction inlet 21 of the compressor 20.

Alternatively, the valve 60 may be a thermal expansion valve (TXV). If the valve 60 is a TXV, then its opening would depend on a set superheat value for the refrigerant flowing in the refrigerant line 7 as sensed by the temperature sensing bulb 65. The TXV type valve 60 would be especially useful for the arrangement shown in FIG. 6 where the unloading bypass line 19 connects an intermediate compression point of the compression process in the compressor 20 to the suction pressure refrigerant line 7. In this case, the refrigerant, preheated by the compressor motor and by the heat of internal compression, is admixed in the refrigerant line 7 with cold refrigerant delivered from the refrigerant bypass line 9. The opening of the TXV 60 is then self-adjusted to maintain the set superheat value of these two mixed refrigerant streams.

If the flow control valve 60 has an opening that can be changed by a controller (such as, for example, the opening changed by a small motor incorporated into the valve body), then the amount of opening and thus the amount of refrigerant delivered to the compressor can be adjusted based on refrigerant temperatures inside the compressor or at the compressor discharge. The amount of opening would be then controlled to assure that enough refrigerant is delivered to the compressor to maintain at least one of these temperatures within the acceptable limit. The measured temperatures may include motor temperature, oil temperature at the compressor oil sump, compressor pump temperature, and discharge refrigerant temperature. It should be pointed out that regardless of how much refrigerant is delivered to the compressor through the bypass refrigerant line 9, the cooling capacity of the refrigerant vapor compression system 10, 100 remains at essentially zero level, since no refrigerant passes through the evaporator 40.

As noted previously, the refrigerant vapor compression system 100 depicted in FIGS. 3 and 4 is an economized refrigerant vapor compression system. As in conventional economized refrigerant vapor compression systems, the refrigerant vapor compression system 100 further includes an economizer circuit comprising an economizer refrigerant line 11, an economizer heat exchanger 50 and an associated economizer expansion device 55 interdisposed in the economizer refrigerant line 11 and an economizer flow control valve 70 interdisposed in the economizer refrigerant line 11 downstream, with respect to refrigerant flow, of the economizer heat exchanger 50. The economizer expansion device 55 may be a restriction type expansion device, such as a capillary tube or a fixed plate orifice, a thermostatic expansion valve operatively associated with a temperature sensing bulb, or an electronic expansion valve. The economizer refrigerant line 11 establishes refrigerant flow communication between the refrigerant line 5 of the primary refrigerant circuit and an intermediate pressure stage of the compression process. It has to be pointed out that many configurations of the economized cycle are known in the art. All these configurations are within the scope of and can equally benefit from the invention.

In the depicted embodiment, the economizer heat exchanger 50 comprises a refrigerant-to-refrigerant heat exchanger having a first refrigerant pass 51 and a second refrigerant pass 53 disposed in heat exchange relationship. The first refrigerant pass 51 is interdisposed in refrigerant line 5 of the primary refrigerant circuit downstream, with respect to refrigerant flow, of the heat rejection heat exchanger 30 and upstream, with respect to refrigerant flow, of the evaporator expansion device 45. The second refrigerant pass 53 is interdisposed in the economizer refrigerant line 11 downstream, with respect to refrigerant flow, of the economizer expansion device 55 and upstream, with respect to refrigerant flow, of the intermediate compression point 25 in the compression device 20. Refrigerant passing through the refrigerant line 5 of the primary refrigerant circuit passes through the first refrigerant pass 51 of the economizer heat exchanger 50 in heat exchange relationship with a portion of the refrigerant flow tapped off the refrigerant line 5 into the economizer refrigerant line 11 to pass through the second refrigerant pass 53 of the economizer heat exchanger 50.

The economizer refrigerant line 11 may tap a portion of refrigerant from the refrigerant line 5 at a location upstream, with respect to refrigerant flow, of the first refrigerant pass 51 of the economizer heat exchanger 50, as depicted in FIGS. 3 and 4, or at a location downstream with respect to refrigerant flow of the first refrigerant pass 51 of the economizer heat exchanger 50. Other economizer cycle arrangements such as, for instance, an economizer cycle with a flash tank are also known in the art and can similarly benefit from the invention. If the compression device 20 of the refrigerant vapor compression system 100 is a single compressor, such as a scroll compressor as illustrated in FIG. 2, the economizer refrigerant line 11 communicates in refrigerant flow via an injection port 25 that opens into an intermediate pressure point of the compression process in the compression device 20. If the compression device 20 of the refrigerant vapor compression system 100 is a pair of compressors, the economizer refrigerant line 11 would communicate in refrigerant flow into a point between the two compressors, where a refrigerant line connects the discharge outlet of the first compressor with the suction inlet to the second compressor.

The refrigerant vapor compression system 100 also includes an evaporator bypass circuit comprising a refrigerant bypass line 13 and a refrigerant flow control device 60 interdisposed in the refrigerant bypass line 13. The refrigerant flow control device 60 has at least a first open position and a second closed position. As described hereinbefore with respect to the non-economized system 10, the refrigerant flow control device 60 may comprise a two-position solenoid valve having a first open position and a second closed position, or a fixed restriction flow device, such as, for example, a capillary tube or a fixed flow area orifice.

In the exemplary embodiment depicted in FIG. 3, the bypass line 13 at its inlet end taps into the economizer refrigerant line 11 at a location downstream, with respect to refrigerant flow, of the second refrigerant pass 53 of the economizer heat exchanger 50 and upstream, with respect to refrigerant flow, of the terminus of the economizer refrigerant line 11 at the injection port 25 opening into an intermediate compression point of the compression device 20, and at its outlet end taps into the refrigerant line 7 of the primary refrigerant circuit at a location downstream, with respect to refrigerant flow, of the suction flow control valve 15 and upstream, with respect to refrigerant flow, of the suction inlet port 21 of the compression device 20. In the exemplary embodiment depicted in FIG. 4, the bypass line 13 at its inlet end taps into the refrigerant line 5 downstream, with respect to refrigerant flow, of the economizer 50 and upstream, with respect to refrigerant flow, of the evaporator 40, and at its outlet end taps into the refrigerant line 7 of the primary refrigerant circuit at a location downstream, with respect to refrigerant flow, of the suction flow control valve 15 and upstream, with respect to refrigerant flow, of the suction inlet port 21 of the compression device 20. The refrigerant line 7 connects with the suction inlet port 21 of the compression device 20 and therefore is at suction pressure.

As in conventional practice, refrigerant vapor is compressed in the compression device 20 from a suction pressure at which the refrigerant vapor enters the suction inlet port 21 of the compression device 20 to a discharge pressure substantially higher than the suction pressure. The hot, high pressure refrigerant vapor passes from the discharge outlet port 23 of the compression device 20 through refrigerant line 3 of the primary refrigerant circuit to and through the heat rejection heat exchanger 30 wherein the hot, high pressure refrigerant passes in heat exchange relationship with a cooling medium, typically ambient outdoor air being drawn through the finned tube heat exchanger by an air mover, such as one or more fans (not shown) operatively associated with the heat rejection heat exchanger 30, to cool the refrigerant vapor.

The refrigerant leaving the heat rejection heat exchanger 30 passes through the refrigerant line 5 of the primary refrigerant circuit to the evaporator 40. In doing so, the refrigerant traverses the evaporator expansion device 45 interdisposed in the refrigerant line 5 and expands to a lower temperature, lower pressure liquid refrigerant or, more commonly, to a liquid/vapor refrigerant mixture, before entering the evaporator 40. In passing through the evaporator 40, the refrigerant is heated thereby evaporating the liquid component and typically superheating the resultant vapor. The secondary fluid, typically air to be supplied to a climate-controlled environment, is conditioned, cooled and typically dehumidified, while passing over external heat exchange surfaces of the evaporator 40. The refrigerant vapor leaving the evaporator 40 passes through the refrigerant line 7 of the primary refrigerant circuit to reenter the compression device 20 through the suction inlet port 21 thereof.

The suction flow control 15 interdisposed in the refrigerant line 7 may be a conventional suction modulation valve or an on/off (i.e. open/closed) solenoid valve. The operation of the refrigerant vapor compression systems 10, 100 will be described hereinafter with a conventional suction modulation valve being utilized as the suction flow control valve 15. However, it is to be understood that the methods of operation are equally applicable when an on/off solenoid valve is used as the suction flow control valve 15.

The refrigerant vapor compression systems 10, 100 also include a system controller 80 that monitors various operating parameters of the system and also controls the overall operation of the system by controlling the operation of various components, including the compression device 20, the respective fans associated with the heat rejection heat exchanger 30 and the evaporator 40, and the positioning of various valves within the system, all in response to the sensed operating parameters. For example, in the embodiment of the non-economized refrigerant vapor compression systems 10 depicted in FIGS. 1, 2, 5 and 6, the controller 80 monitors the temperature within the controlled environment 2 via a temperature sensor 85, such as for example a thermostat or other temperature sensing device. Additionally, the controller 80 selectively positions each of the electronic expansion valve 45, the suction modulation valve 15, and the evaporator bypass valve 60. When there is a demand for cooling, that is when the controller 80 detects that the sensed temperature within the climate-controlled environment 2 exceeds a desired set point temperature by more than a preselected amount, the controller 80 positions the suction modulation valve 15 in a desired position, typically a more open, position, positions the evaporator bypass flow control valve 60 in its closed position, and modulates the opening of the electronic expansion valve 45 to maintain a desired refrigerant temperature at the outlet of the evaporator 40 or at the inlet to compressor 20. However, when the controller 80 detects that sensed temperature within the climate-controlled environment 2 is at or within a narrow range below the desired set point temperature, such as for example one degree Celsius, the controller 80 repositions the suction modulation valve 15 to a more or fully closed position and repositions the evaporator bypass flow control valve 60 to its open position. With the SMV 15 in its closed position and the bypass flow control valve 60 open, refrigerant flow through the evaporator 40 is reduced to zero or nearly zero amount. The compression device 20 remains energized and circulating substantially all of the refrigerant from the discharge outlet 23 of the compression device 20 through the refrigerant line 3 and the heat rejection heat exchanger 30 into the refrigerant line 5 and thence through the evaporator bypass line 9 and into the refrigerant line 7 downstream of the SMV 15 and into the suction inlet 21 of the compression device 20, thereby bypassing the evaporator 40. With substantially all of the refrigerant bypassing the evaporator 40, further cooling of the climate-controlled environment 2 is avoided, thereby permitting tight temperature control while still maintaining the compression device 20 in operation.

In the embodiments of the economized refrigerant vapor compression system 100 depicted in FIGS. 3 and 4, the controller 80 again monitors the temperature within the controlled environment 2 via a temperature sensor 85, such as for example a thermostat or other temperature sensing device.

Additionally, the controller 80 selectively positions each of the suction modulation valve 15, the economizer flow control valve 70, and the evaporator bypass valve 60. When there is demand for cooling, that is when the controller 80 detects that the sensed temperature within the climate-controlled environment 2 exceeds a desired set point temperature by more than a preselected amount, the controller 80 positions the suction modulation valve 15 in a more open position, may position the economizer flow control valve 70 in its open position, positions the evaporator bypass flow control valve 60 in its closed position, and, if the expansion device 45 is an electronic expansion valve, modulates the opening of the electronic expansion valve 45 to maintain a desired refrigerant temperature at the outlet of the evaporator 40. If the expansion device 45 is a thermal expansion valve, the thermal expansion valve 45 modulates refrigerant flow in response to a temperature sensing bulb 47 mounted on or otherwise operatively associated with the refrigerant line 7 downstream, with respect to refrigerant flow, of the outlet of the evaporator 40. However, when the controller 80 detects that sensed temperature within the climate controlled environment 2 is at or within a narrow range below the desired set point temperature, such as for example one degree Celsius, the controller 80 repositions the suction modulation valve 15 to a more closed or a fully closed position, repositions the economizer flow control valve 70 to a closed position, and repositions the evaporator bypass flow control valve 60 to its open position. With the SMV 15 and the economizer flow control valve 70 in their respective closed positions and the bypass flow control valve 60 open, refrigerant flow through the evaporator 40 is reduced to zero or nearly zero. The compression device 20 remains energized and circulating substantially all of the refrigerant from the discharge outlet 23 of the compression device 20 through the refrigerant line 3 and the heat rejection heat exchanger 30 into the refrigerant line 5 and thence through the second pass 53 of the economizer heat exchanger 50 and through the evaporator bypass line 9, into the refrigerant line 7 downstream of the SMV 15 and into the suction inlet 21 of the compression device 20, thereby bypassing the evaporator 40. With substantially all of the refrigerant bypassing the evaporator 40, further cooling of the climate-controlled environment 2 is avoided, thereby permitting tight temperature control while still maintaining the compression device 20 in operation.

In the conventional method of operating a refrigerant vapor compression at low system capacity, the suction modulation valve 15 is partially, but not fully or near fully closed, to throttle refrigerant flow from the evaporator 40 through the refrigerant line 7 to the suction inlet 21 of the compression device 20. However, a relatively significant minimum refrigerant flow must be maintained through the refrigerant line 7, and therefore through the evaporator 40 and to the suction inlet 21 of the compression device 20 to maintain the suction inlet refrigerant pressure above a required minimum level to avoid damage to the compression device 20. With such a minimum refrigerant flow through the evaporator 40, a certain level of cooling of the climate-controlled environment will occur, even at low capacity operation of the compression device 20, thereby rendering tight temperature control within the climate-controlled environment very difficult to attain, since the compressor has to cycle between ON and OFF positions.

In the previously described method of operation of the refrigerant vapor compression systems 10, 100, it is possible to attain zero or near-zero system capacity operation, even though the compression device 20 is still operating. Zero or near-zero capacity operation is attainable because substantially all of the refrigerant circulating through the refrigerant circuit is bypassed around the evaporator and into the suction line downstream of the suction modulation valve 15. Thus, substantially all of the refrigerant passes into the suction inlet 21 of the compression device 20, thereby ensuring that the suction inlet pressure is maintained at a level sufficient for protection of the compression device 20. In the non-economized refrigerant vapor compression system 10, the bypassed refrigerant returns to the compression device 20 through the refrigerant line 7 as liquid, or more typically two-phase, refrigerant. In the economized refrigerant vapor compression system 100, the bypassed refrigerant returns to the compression device 20 through the refrigerant line 7 as a liquid and vapor mixture or vapor refrigerant.

In the aforedescribed method of operation, it is also possible to operate the refrigerant vapor compression system at near zero capacity. To do so, the controller 80 may modulate the suction modulation valve 15 between a fully closed position and a partially or fully open position, thereby permitting pulses of refrigerant vapor to pass from the refrigerant line 5 through the evaporator 40. The amount of refrigerant flowing through the evaporator 40 is therefore controlled by the cycle time at the open and closed positions for the suction modulation valve 15. By doing so, the controller 80 can ensure that a controlled amount of the time-averaged cooling of the climate-controlled environment is provided in an amount sufficient to keep the temperature from rising above the set point temperature during operation in the tight temperature control mode, but not so excessive as to drive the temperature within the temperature controlled environment lower than the desired set point range.

If the suction flow control valve 15 is a on/off solenoid valve rather then a suction modulation valve, the controller 80 would position the solenoid valve 15 in a first open position when the system is operating under load and refrigerant flow through the evaporator 40 is required, such as during pull-down for the climate-controlled environment, and reposition the solenoid valve 15 to a second closed position to substantially eliminate refrigerant flow through the evaporator 40 when operation of the refrigerant vapor compression system under a tight temperature control is desired. When necessary, the on/off solenoid valve can be rapidly cycled between its open and closed positions to provide a minimum level of refrigerant flow through the refrigerant suction line 7.

If the electronic expansion valve 45 is used as an expansion device and this electronic expansion valve can be shut tight, such that no refrigerant passes through this electronic expansion valve 45. Then, the suction modulation valve 15, if it is an ON/OFF valve, can be eliminated from the system, as the refrigerant flow in the refrigerant line 5 and evaporator 40 can be totally blocked by tightly closing the electronic expansion valve 45.

It should be noted that the described methods and systems can be applied in various air-conditioning and refrigeration applications that can include residential cooling units and heat pumps, commercial and roof top air conditioning units, truck-trailer and container refrigeration systems, and supermarket refrigeration systems. It can also include different compressors such as scroll compressors, rotary compressors, screw compressors, and centrifugal compressors. The compressors can be of a fixed speed, multi-speed or variable speed, driven by a variable speed drive, type. While the method of operation described herein has been described with reference to the exemplary embodiments as illustrated in the drawings, it will be understood by one skilled in the art that various changes in detail may be implemented therein without departing from the spirit and scope of the invention as defined by the claims. For example, an on/off solenoid valve may be employed as the suction flow control valve 15 in substitution for the suction modulation valve 15.

We claim:

1. A method of operating a refrigerant vapor compression system at substantially zero capacity, the refrigerant vapor compression system including a refrigerant compression device, a heat rejection heat exchanger, an evaporator refrigerant expansion device, and an evaporator disposed in series in a refrigerant flow circuit, said method comprising the step of:

providing a bypass line establishing refrigerant flow communication between a first location downstream, with respect to refrigerant flow, of said heat rejection heat exchanger and upstream, with respect to refrigerant flow, of said evaporator refrigerant expansion device and a second location downstream, with respect to refrigerant flow, of said evaporator and upstream, with respect to refrigerant flow, of said compression device;

providing a bypass flow control device interdisposed in said bypass line;

providing an evaporator flow control device in said refrigerant flow circuit downstream, with respect to refrigerant flow, of said first location, and upstream, with respect to refrigerant flow, of said second location; and selectively closing said evaporator flow control device and simultaneously opening said bypass flow control device to divert substantially all refrigerant flow from said refrigerant flow circuit at said first location through said bypass line to reenter said refrigerant flow circuit at said second location, wherein the step of providing a bypass flow control device interdisposed in said bypass line comprises providing a solenoid valve having a first closed position and a second open position, and wherein a fixed restriction flow control device is interdisposed in said bypass line in serial refrigerant flow communication with said solenoid valve.

2. A method of operating a refrigerant vapor compression system as recited in claim 1 wherein said solenoid valve is rapidly cycled between said first closed position and said second open position.

3. A method of operating a refrigerant vapor compression system as recited in claim 1 wherein the step of providing a bypass flow control device interdisposed in said bypass line comprises providing a modulation valve.

4. A method of operating a refrigerant vapor compression system as recited in claim 1 wherein the step of providing an evaporator flow control device in said refrigerant flow circuit comprises providing a suction modulation valve in said refrigerant flow circuit.

5. A method of operating a refrigerant vapor compression system as recited in claim 1 wherein the step of providing an evaporator flow control device in said refrigerant flow circuit comprises providing a solenoid valve having a first closed position and a second open position.

6. A method of operating a refrigerant vapor compression system as recited in claim 5 wherein said solenoid valve is rapidly cycled between said first closed position and said second open position.

7. A method of operating a refrigerant vapor compression system as recited in claim 1 further comprising the step of providing a bypass flow expansion device interdisposed in said bypass line upstream, with respect to refrigerant flow therethrough, of said bypass flow control valve.

8. A method of operating a refrigerant vapor compression system as recited in claim 7 wherein the step of providing a bypass flow expansion device in said bypass line comprises providing an electronic expansion valve in said bypass line.

9. The method of claim 1, wherein providing an evaporator flow control device comprises positioning said evaporator flow control device in said refrigerant flow circuit downstream, with respect to refrigerant flow, of said evaporator, and upstream, with respect to refrigerant flow, of said second location.

10. A method of operating a refrigerant vapor compression system as recited in claim 9 wherein said solenoid valve is rapidly cycled between said first closed position and said second open position.

11. A method of operating a refrigerant vapor compression system as recited in claim 9 wherein the step of providing a bypass flow control device interdisposed in said bypass line comprises providing a modulation valve.

12. A method of operating a refrigerant vapor compression system as recited in claim 9 further comprising the step of providing a bypass flow expansion device interdisposed in said bypass line upstream with respect to refrigerant flow therethrough of said bypass flow control valve.

13. A method of operating a refrigerant vapor compression system as recited in claim 12 wherein the step of providing a bypass flow expansion device in said bypass line comprises providing an electronic expansion valve in said bypass line.

14. The method of claim 1, wherein providing an evaporator flow control device comprises providing an expansion valve as said evaporator refrigerant expansion device.

15. The method of claim 14, wherein providing an expansion valve comprises providing an electronic expansion valve.

* * * * *